US008043057B1

(12) United States Patent
Liang

(10) Patent No.: US 8,043,057 B1
(45) Date of Patent: Oct. 25, 2011

(54) AIR COOLED TURBINE AIRFOIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 976 days.

(21) Appl. No.: 12/004,961

(22) Filed: Dec. 21, 2007

(51) Int. Cl.
*F04D 29/38* (2006.01)

(52) U.S. Cl. ..... 416/97 R; 416/96 A

(58) Field of Classification Search ..... 415/115, 415/116; 416/96 R, 96 A, 97 R
See application file for complete search history.

(56) References Cited

U.S. PATENT DOCUMENTS 6,193,465 B1 * 2/2001 Liotta et al. ..... 416/96 A
6,874,988 B2 * 4/2005 Tiemann ..... 415/115

* cited by examiner

*Primary Examiner* — Edward Look
*Assistant Examiner* — Dwayne J White
(74) *Attorney, Agent, or Firm* — John Ryznic

(57) ABSTRACT

A turbine airfoil with a multiple impingement cooling circuit to provide backside impingement cooling of the leading edge region and the pressure and suction side walls. A leading edge cavity and a mid-chord cavity are separated by a rib. A first baffle is secured within the leading edge cavity and forms a series of impingement compartments and impingement cooling holes to channel cooling air along the first baffle and provide impingement cooling along the backside wall of the leading edge region. A second baffle is secured within the mid-chord cavity and forms a series of pressure side and suction side impingement compartments and impingement cooling holes alternating from the pressure side wall to the suction side wall to channel cooling air along the second baffle and provide impingement cooling along the backside walls of the pressure and suction sides. A spent air collection channel extends along the trailing edge region and is connected to a row of exit cooling holes along the trailing edge of the airfoil. Cooling air from the first baffle flows into the second baffle, and from the second baffle into the spend air collection channel and out through the exit cooling holes.

17 Claims, 3 Drawing Sheets

View B-B

View B-B

View C-C

AIR COOLED TURBINE AIRFOIL

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine airfoil with multiple impingement cooling.

2. Description of the Related Art Including Information Disclosed Under 37 CFR 1.97 and 1.98

In a gas turbine engine, a fuel is combined with compressed air to create a hot gas flow that is passed through a turbine to drive a rotor shaft. In an industrial gas turbine engine, a typical four stage turbine provides the mechanical power to drive the rotor shaft, which drives the compressor and an electric generator to produce electrical power. The efficiency of a gas turbine engine can be increased by passing a higher temperature flow into the turbine. However, the turbine inlet temperature is dependent upon the material capabilities of the turbine, especially the first stage stator vanes and rotor blades.

One way to allow for higher turbine inlet temperatures is to provide cooling for the hotter airfoils. A combination of internal convection cooling, impingement cooling and film cooling on the exterior airfoil surfaces have been proposed to allow for higher flow temperatures.

Since the cooling air used for the turbine airfoils is bled off from the compressor, this work performed to compress the air is not available to perform work in the turbine. Thus, another way of increasing the efficiency of the engine is to use a minimum amount of cooling air while also providing the maximum amount of cooling with this cooling air.

BRIEF SUMMARY OF THE INVENTION

It is therefore an object of the present invention to provide for an increase in the efficiency of a gas turbine engine by improving the cooling capability of the airfoils.

It is another object of the present invention to provide for a turbine airfoil with multiple impingement cooling.

The present invention is a turbine airfoil, such as a stator vane or a rotor blade, with multiple impingement cooling of the leading edge region followed by multiple impingement cooling of the mid-chord region on the pressure side and the suction side walls. Pressurized cooling air flows through a series of impingement compartments, impingement holes and spent air return holes in series along the leading edge before discharging through a spent air channel and then into a series of the mid-chord impingement compartments. In the mid-chord region, the cooling air flows in a series through an impingement compartment, through impingement holes and against the pressure side wall, then through a spent air return hole into the next impingement compartment. From this next impingement compartment, the cooling air flows through impingement holes and against the suction side wall, and then through another spent air return hole and into the next impingement compartment to repeat the series of flow. From the mid-chord series of impingement compartments and impingement holes, the spent air flows into a channel and then into the trailing edge collector channel, and then through a row of trailing edge cooling air exit holes spaced along the trailing edge of the airfoil.

DETAILED DESCRIPTION OF THE INVENTION

Figure 1:
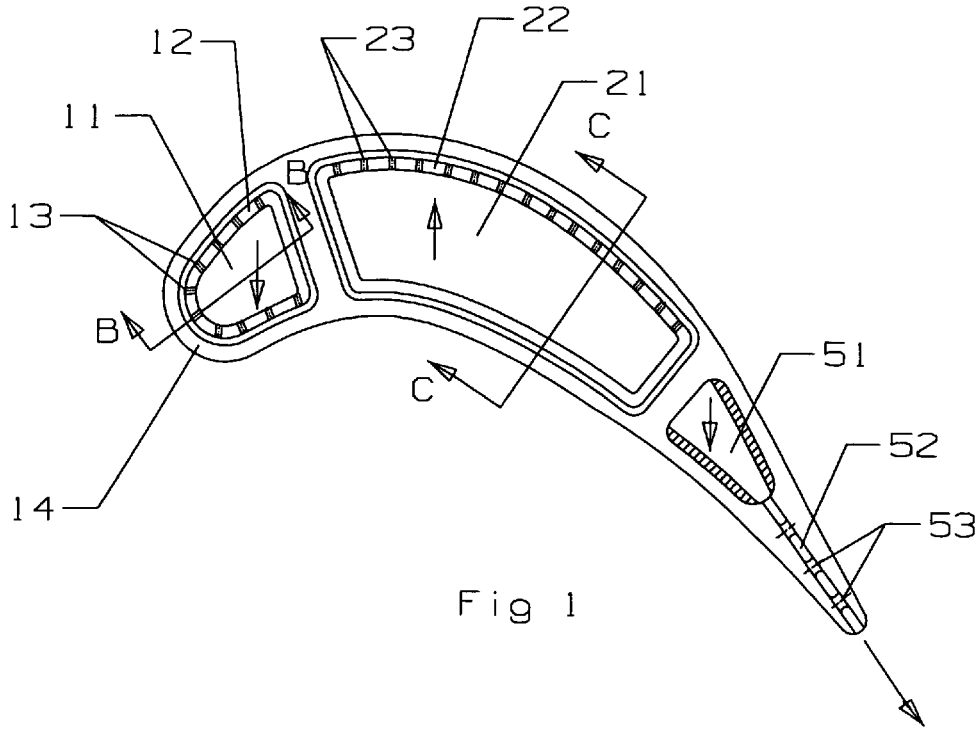
FIG. 1 shows a cross section top view of the multiple impingement cooling circuit of the present invention.

The present invention is a turbine airfoil with an internal cooling circuit that provides for multiple impingement cooling of the airfoil walls. The airfoil can be a rotor blade or a stator vane. FIG. 1 shows a cross section top view of the cooling circuit in a stator vane, and includes a leading edge cavity extending along the airfoil spanwise direction, a mid-chord cavity separated from the leading edge cavity by a first rib extending across the airfoil walls from the pressure side to the suction side, and a trailing edge cavity separated from the mid-chord cavity by a second rib also extending across the airfoil walls. The two ribs separate the cavities from each other and provide rigidity to the airfoil.

Located within the leading edge cavity is a leading edge impingement compartment 11 formed within a leading edge impingement baffle 12, the baffle including a plurality of impingement holes 13 spaced around the baffle 13 to direct impingement cooling air to the inner surface of the leading edge wall of the airfoil. The mid-chord region of the airfoil includes a mid-chord impingement compartment 21 formed within a mid-chord impingement baffle 22 placed within the mid-chord cavity, the baffle including a plurality of impingement holes 23 spaced around the pressure side and the suction side walls of the airfoil. The trailing edge region includes a spent air collector channel 51 and a row of exit cooling holes 52 each with a plurality of pin fins 53 located in the exit channel 52.

Figure 2:
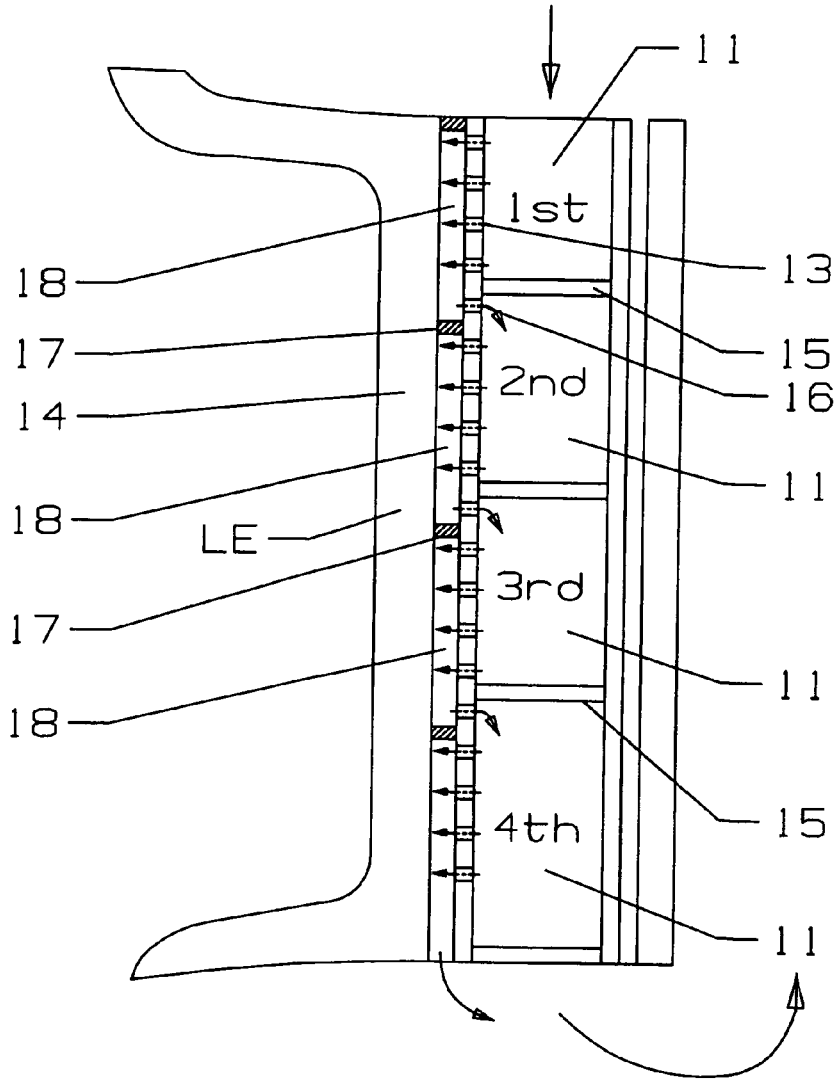
FIG. 2 shows a cross section side view of the airfoil of the present invention through the leading edge region.

FIG. 2 shows a front view of the leading edge cavity with the impingement compartments of FIG. 1. At the top of the leading edge region is the impingement compartment 11. The impingement baffle 12 includes a plurality of impingement holes 13 arranged along the spanwise direction of the airfoil to discharge impingement cooling air against the inner surface of the leading edge wall 14. The impingement baffle 12 includes a separating wall or floor 15 for each of the separate impingement compartments spaced along the leading edge region of the airfoil. A spent air return hole 16 returns the cooling air from the spent air channel 18 at the inner wall surface and into the next impingement compartment 11. A stand-off 17 separates the adjacent spent air channel 18 and forces the spent air into the next impingement compartment 11 in the series along the leading edge region. The last and lower-most impingement compartment 11 in the leading edge region discharges the cooling air into a spent air channel and then into the mid-chord impingement compartment 21 located on the bottom of the airfoil.

Figure 3:
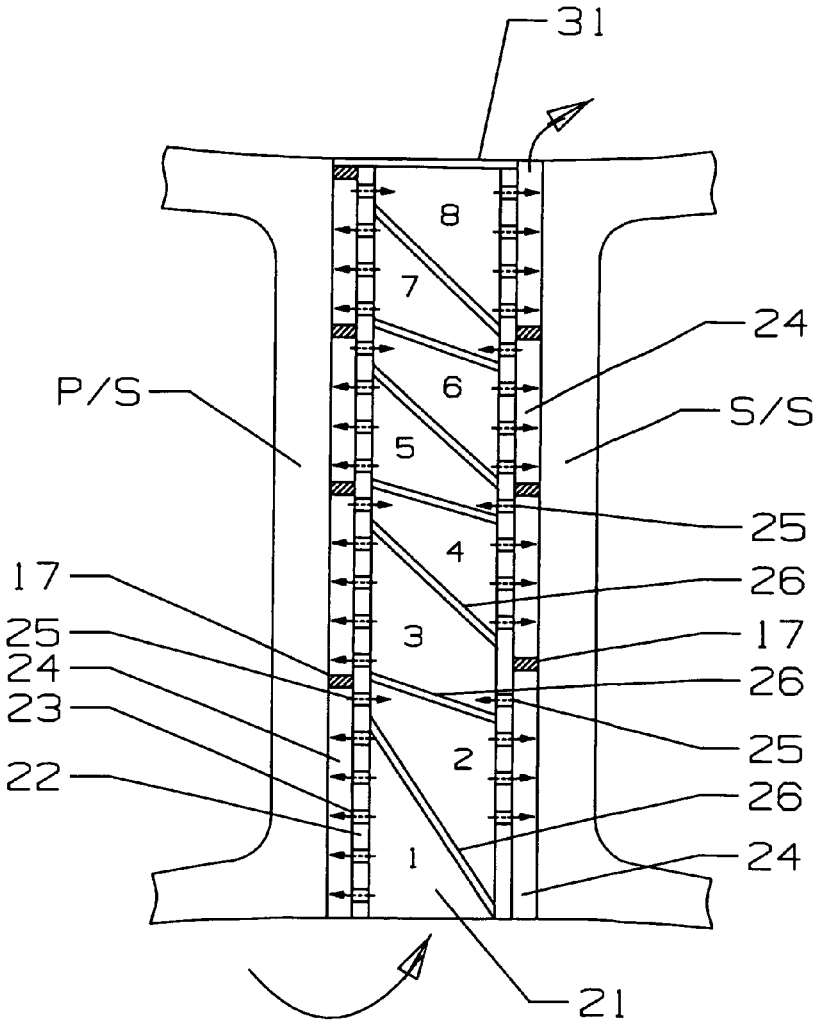
FIG. 3 shows a cross section side view of the airfoil of the present invention through the mid-chord region.

FIG. 3 shows a cross section side view of the mid-chord cooling circuit in which the spent air from the lower-most compartment 11 in the leading edge region flows into the first impingement compartment 21 in the mid-chord region. The impingement baffle 22 includes impingement holes 23 on the leading edge side. The impingement baffle 22 also includes slanted walls or floors 26 that separate the compartments 21. Stand-offs 17 are also used to separate the spent air channels 24 on the pressure side and the suction side of the airfoil. Spent air return holes 25 are located on both sides to return the impingement air from the impingement spaces into the next impingement compartment 21 in a series of flow along the circuit. An end cap 31 closes the last and top-most compartment in the mid-chord region. The spent cooling air from the last compartment (number 8 in this figure) flows into the spent air channel 24 and then into the trailing edge collector channel 51 shown in FIG. 1. As seen in FIG. 1, the impingement compartment 22 has impingement holes 23 only on the suction side of the airfoil. As seen in FIG. 3, each of the separated impingement compartments (8 in this figure) has impingement holes on either the pressure side or the suction side and not both. Compartment 1 has holes on the pressure side, compartment 2 has holes on the suction side, and compartment 3 has holes on the pressure side. The holes alternate from one side to the other due to the separation walls 26.

The trailing edge collector channel 51 extends along the airfoil and includes trip strips along the walls to enhance the heat transfer to the cooling air flow, and a row of exit holes 52 each with a plurality of pin fins 53 to discharge the cooling air out the trailing edge. FIG. 2 shows 4 impingement compartments in the leading edge region and FIG. 3 shows 8 impingement compartments in the mid-chord region. However, these two regions can have more or less compartments depending upon the cooling requirements or capabilities. Also, cooling air pressure and volume flow will determine the number of compartments needed as well as the size and number of impingement holes.

In operation, pressurized cooling air is supplied to the top impingement compartment 11 on the leading edge region as seen in FIGS. 1 and 2 by the arrow. The cooling air flows through the impingement holes 13 and against the inner wall of the leading edge, then down the spent air channel 18 and through the spent air return hole 16. The cooling air flows into the next impingement compartment 11 ($2^{nd}$) and through the impingement holes associated with the $2^{nd}$ impingement compartment to provide impingement cooling to the backside of the leading edge wall. the cooling air serpentines through the remaining spent air cooling holes and impingement compartments and into the last and lower-most spent air channel from the $4^{th}$ impingement compartment as seen in FIG. 2.

The cooling air from the lower-most spend air channel 18 then flows up and into the first and lower-most impingement compartment 21 in the mid-chord region as seen in FIG. 3. the cooling air passes through the impingement holes 23 to provide impingement cooling against the pressure side wall, up the spend air channel 24, through the spent air return hole 25, and into the next impingement compartment 21 located above (the $2^{nd}$ compartment). The cooling air in the $2^{nd}$ impingement compartment then flows through the impingement holes onto the backside of the suction side wall to provide impingement cooling here. From the spent air channel 24 on the suction side, the cooling air then flows through the spent air return hole 25 and into the $3^{rd}$ impingement compartment. The cooling air continues in this flow pattern—impingement compartment, impingement holes, spent air channel, spent air return hole—upwards and into the $8^{th}$ compartment and then through the impingement holes and into the spent air channel 24.

The cooling air from the spend air channel at the top-most location of the airfoil then flows into the trailing edge spent air collection channel 51 lined with the trip strips on the two walls, through the row of exit cooling holes and out the trailing edge of the airfoil, passing around the pin fins 53 as the cooling air passes through the exit holes.

The unique multiple impingement cooling circuit of the present invention provides the total cooling air multiple impingement cooling arrangement for the turbine airfoil. Also the maximum usage of the cooling air for a given inlet gas temperature and pressure profile is achieved. In addition, the use of total cooling for repeating impingement process generates extremely high turbulence flow level for a fixed amount of coolant flow and therefore creates a high value of internal heat transfer coefficient. As a result, the circuit yields higher internal convective cooling effectiveness than the prior art single pass impingement circuit used in the state-of-the-art turbine airfoil cooling design.

I claim the following:

1. An air cooled turbine airfoil comprising:

a leading edge and a trailing edge;

a pressure side wall and a suction side wall;

a leading edge cavity formed in the leading edge region of the airfoil;

a mid-chord cavity located aft separated from the leading edge cavity by a rib; and, a first baffle secured within the leading edge cavity, the first baffle forming a series of impingement compartments such that cooling air flows from one compartment to the next compartment, adjacent compartments being connected by a plurality of impingement holes and a spent air return hole.

2. The air cooled turbine airfoil of claim 1, and further comprising;

the a spent air channel associated with each impingement compartment and connected thereto through associated impingement holes, the spent air channel being formed by the leading edge wall, and adjacent spend air channels being separated by a stand-off.

3. The air cooled turbine airfoil of claim 1, and further comprising;

a second baffle secured within the mid-chord cavity, the second baffle forming a series of pressure side wall impingement compartment and suction side wall impingement compartments, the pressure side wall compartments alternating between the suction side wall compartments.

4. The air cooled turbine airfoil of claim 3, and further comprising;

the pressure side wall compartments are separated from the suction side wall compartments by slanted floors.

5. The air cooled turbine airfoil of claim 4, and further comprising;

pressure side impingement holes in the pressure side wall compartments; and, suction side impingement holes in the suction side wall compartments.

6. The air cooled turbine airfoil of claim 5, and further comprising;

the slanted floors allow for some of the pressure side impingement holes to be spanwise aligned with some of the suction side impingement holes in adjacent compartments.

7. The air cooled turbine airfoil of claim 3, and further comprising;

cooling air connection means to connect the cooling air outlet from the first baffle to the inlet of the second baffle.

8. The air cooled turbine airfoil of claim 3, and further comprising;

each of the pressure side wall and suction side wall compartments located inside of the end compartments includes a spend air return hole to supply cooling air into the compartment and a plurality of impingement holes to discharge cooling air from the compartment.

9. The air cooled turbine airfoil of claim 3, and further comprising;

spent air channels formed along the pressure side wall and the suction side wall, adjacent spent air channels being separated by a stand-off.

10. The air cooled turbine airfoil of claim 9, and further comprising;

the last spend air channel in the series flow connected to a spent air collection channel located in the trailing edge region of the airfoil; and, a row of trailing edge exit holes connecting the spent air collection channel.

11. A process for cooling an airfoil used in a gas turbine engine, the process comprising the steps of:

supplying pressurized cooling air to a first leading edge impingement compartment;

impinging cooling air onto a first surface of the leading edge wall;

collecting the first impinging cooling air into a second impingement compartment;

impinging the cooling air from the second impingement compartment onto a second surface of the leading edge wall different from the first surface;

collecting the second impinging air into a last impingement compartment; and, impinging the cooling air from the last compartment onto a last surface of the leading edge wall different from the first and the second surfaces.

12. The process for cooling an airfoil of claim 11, and further including the steps of:

collecting the last compartment impinging air into a first mid-chord impinging compartment;

impinging cooling air onto a first surface of the pressure side wall of the airfoil;

collecting the impinging cooling air into a second mid-chord impinging compartment; and, impinging cooling air onto a first surface of the suction side wall of the airfoil.

13. The process for cooling an airfoil of claim 12, and further including the steps of:

collecting the first suction side wall impinging cooling air into a third mid-chord impinging compartment; and, impinging cooling air onto a second surface of the pressure side wall.

14. The process for cooling an airfoil of claim 13, and further including the steps of:

collecting the first surface of the pressure side wall impinging cooling air into a fourth mid-chord impinging compartment; and, impinging cooling air onto a second surface of the suction side wall.

15. An air cooled turbine airfoil comprising:

a leading edge and a trailing edge;

a pressure side wall and a suction side wall;

a leading edge cavity extending along the spanwise length of the airfoil;

a mid-chord cavity extending along the spanwise length of the airfoil;

the leading edge cavity and the mid-chord cavity separated by a rib;

a leading edge impingement baffle secured within the leading edge cavity, the leading edge impingement baffle forming a series of impingement compartments and impingement holes to channel cooling air along the airfoil and provide impingement cooling along the leading edge wall of the airfoil;

a mid-chord impingement baffle secured within the mid-chord cavity, the mid-chord impingement baffle forming a series of pressure side and suction side impingement compartments and impingement holes to channel cooling air along the airfoil and provide impingement cooling along the pressure side and the suction side walls of the airfoil; and, means to channel the cooling air from the outlet of the leading edge baffle to the inlet of the mid-chord baffle.

16. The air cooled turbine airfoil of claim 15, and further comprising:

a spent air collection channel aft of the mid-chord cavity and in the trailing edge region of the airfoil;

a row of exit cooling holes along the trailing edge of the airfoil and connected to the spent air collection channel; and, means to channel the cooling air from the outlet of the mid-chord baffle to the inlet of the spent air collection channel.

17. The air cooled turbine airfoil of claim 16, and further comprising:

the airfoil has no film cooling holes and all of the cooling air supplied to the leading edge baffle is eventually discharged through the exit cooling holes along the trailing edge of the airfoil.

* * * * *